United States Patent [19]

Kirchweger et al.

[11] 4,188,924

[45] Feb. 19, 1980

[54] INTERNAL COMBUSTION ENGINE VENTILATION

[75] Inventors: Karl Kirchweger; Bernd Pfeifer, both of Graz, Austria; Hans List, 126, Heinrichstrasse, Graz, Austria; Josef Greier, Graz, Austria

[73] Assignee: Hans List, Graz, Austria

[21] Appl. No.: 825,778

[22] Filed: Aug. 18, 1977

[30] Foreign Application Priority Data

Aug. 27, 1976 [AT] Austria ..... 6373/76

[51] Int. Cl.[2] ..... F01P 5/02; F01P 5/06

[52] U.S. Cl. ..... 123/41.65; 123/41.7; 123/195 C; 123/195 S; 123/198 E; 181/204

[58] Field of Search ..... 123/41.65, 41.69, 41.7, 123/41.63, 41.6, 41.79, 195 C, 195 S, 198 E; 181/204

[56] References Cited

U.S. PATENT DOCUMENTS

| | | | |
|---|---|---|---|
| 2,893,361 | 7/1959 | Badertscher | 123/41.65 |
| 2,968,293 | 1/1961 | Kolbe | 123/41.69 |
| 3,598,093 | 8/1971 | Tanaka | 123/41.65 |
| 3,618,691 | 9/1971 | Honda | 123/41.65 |
| 3,650,249 | 3/1972 | Honda | 123/41.65 |
| 3,684,053 | 8/1972 | Fachbach et al. | 123/198 E |
| 4,086,886 | 5/1978 | Edmaier et al. | 123/41.65 |

FOREIGN PATENT DOCUMENTS

| | | | |
|---|---|---|---|
| 2737262 | 3/1978 | Fed. Rep. of Germany | 123/198 E |
| 1221589 | 6/1960 | France | 123/41.7 |

*Primary Examiner*—Charles J. Myhre
*Assistant Examiner*—Jeffrey L. Yates
*Attorney, Agent, or Firm*—Watson, Cole, Grindle & Watson

[57] ABSTRACT

A ventilation system for an encapsulated internal combustion engine providing a reduction in short-circuit air flow from the pressure side to the suction side of the ventilation radial fan.

2 Claims, 2 Drawing Figures

INTERNAL COMBUSTION ENGINE VENTILATION

BACKGROUND OF THE INVENTION

This invention relates to improvements in internal combustion engine ventilation, in particular to means for ventilating the space between the exterior walls of an internal combustion engine and an associated encapsulation surrounding the same in spaced relation therewith, comprising a rotor of a radial fan arranged within the encapsulation on a shaft of the internal combustion engine and an air intake duct leading from an air inlet opening in the encapsulation to the suction side of the fan.

In a previously proposed ventilation system of the kind specified for application to an internal combustion engine which has been encapsulated for noise suppression, the encapsulation is secured by means of resonance-insulating elastic support elements on the engine block. Because of the elastic supports for the encapsulation on the engine and in view of unavoidable fitting tolerances, it is necessary to leave a comparatively wide gap between the air intake duct and the rotor wheel of the fan. Such gap gives rise to a certain degree of short-circuit flow from the pressure area following the fan towards the intake or suction side of the fan which reduces the effectiveness of the fan.

The present invention aims to avoid the disadvantages appertaining to this conventional arrangement and to provide a ventilation system which allows a highly aerodynamically efficient design of fan to be used without impairing the acoustic efficiency of the noise-suppressing encapsulation.

SUMMARY OF THE INVENTION

According to this invention means are provided for ventilating the space between the exterior walls of an internal combustion engine and an encapsulation surrounding the same in spaced relation therewith, comprising a radial fan rotor mounted on a shaft of the engine within the encapsulation and an air duct leading from the intake orifice of the encapsulation to the aspiration side of the fan, characterized in that a plate including an aspiration orifice is rigidly connected to the engine on the suction side of the fan (the side of the fan opposite the side facing the engine), the plate and the fan rotor being arranged to define the closest possible airgap therebetween and a hightly elastic, body-resonance-absorbing intermediate piece is provided in the air duct between the intake orifice of the encapsulation and the aspiration orifice of the plate.

Thanks to these provisions, the loss due to short-circuit flow of air through the air gap is reduced to a minimum by extremely simple and inexpensive means without any impairment of relative movability between the fan which is rigidly connected to the engine and the air intake duct which is rigidly connected to the encapsulation. Since the fan and the air intake duct are relatively separated in a body resonance-absorbing manner there can be no resonance transmission through these parts from the engine to the encapsulation.

According to a preferred embodiment of this invention the encapsulation comprises on the fan side thereof a cover part which contains the air intake duct as well as an overflow aperture corresponding to the aspiration aperture in the plate and the highly elastic intermediate part or buffer consists of a ring seal fitted in the region around the aspiration aperture between the plate and the cover part. This constructional arrangement is distinguished by its particular simplicity with regard to construction and assembly. For replacing the ring seal, when required, or any type of maintenance work on the fan no more is needed than removal of the end cover part on the side of the fan.

According to another embodiment of this invention the air intake duct may comprise an aspiration or suction pipe rigidly connected with the encapsulation and an air-duct housing rigidly connected with the plate and situated within the encapsulation, which housing is connected to said suction pipe by means of a highly elastic rubber boot. This arrangement also permits comparatively large relative movements of the two component parts of the air intake and supply ducting.

The invention will be hereinafter more specifically explained with reference to two embodiments thereof illustrated in the accompanying drawings.

Figure 1:
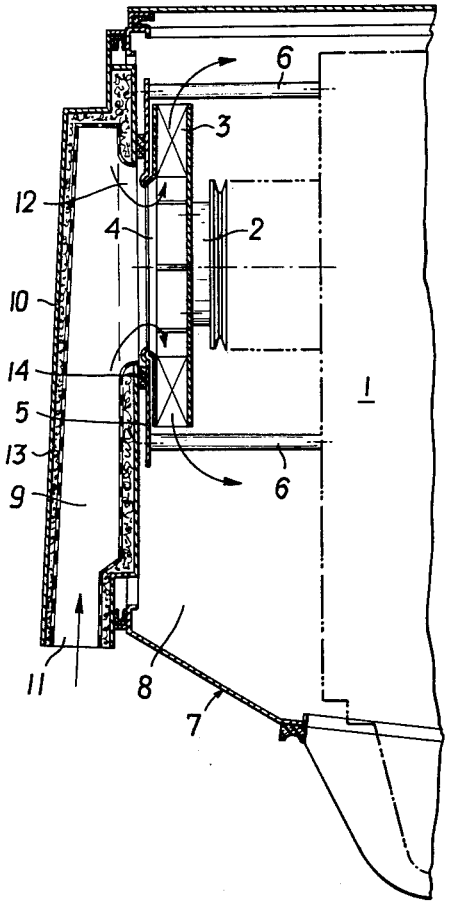
FIG. 1 is a sectional view of a ventilation system according to the present invention for application to a noise-suppressed encapsulated internal combustion engine.

The drawings are diagrammatical and confined to the parts which are essential to the present invention.

DETAILED DESCRIPTION OF THE PREFERRED EMBODIMENTS

The internal combustion engine 1, which is merely indicated in the drawing by dot and dash lines, comprises at the frontal side a shaft 2, driven, for example, by a V-belt, whereon is mounted a radial fan rotor 3. Forwardly of this rotor 3 there is provided a plate 5 which comprises an intake or aspiration aperture 4 and which is rigidly connected by means of spacer sleeves 6 to the engine 1 in such a way as to define a narrow air gap between itself and the rotor 3.

The engine 1 is provided with a multi-part noise suppressing encapsulation 7 (only partly illustrated) which is secured to the engine block in a manner (not shown) by means of elastic, body resonance-absorbing support elements. The fan 3 is adapted in per se known fashion to ventilate the space 8 between the exterior walls of the engine 1 and the encapsulation 7. The cooling air which enters in the direction of the arrows shown in the drawing from the fan 3 into this space 8 is conducted along the exterior walls of the engine 1 and subsequently leaves the encapsulation through one or more air outlet orifices (not shown).

In the embodiment of the invention shown in FIG. 1 cooling air is supplied to the fan 3 through an air intake duct 9 formed in an end cover part 10 on the frontal side of the noise-suppressing encapsulation 7. For this purpose the cover part 10, which is partly of double-walled design, comprises an inlet orifice 11 for cooling air as well as an overflow or airflow-transfer orifice 12 which corresponds positionally with the intake orifice 4 of the plate 5. The interior walls of this air duct 9 are lined with a sound absorbing material 13.

In the region around the aspiration and air-transfer orifices, 4 and 12 respectively, a highly elastic, body-resonance absorbing intermediate piece in the form of a ring seal 14 is inserted between the plate 5 and the cover part 10. This high - elasticity seal 14 can absorb relative movement arising between the cover part 10 and the plate 5, as the plate is rigid with the engine 1 and the encapsulation 7 is elastically mounted on the engine 1, and also compensate fitting tolerances between engine and encapsulation 7. The body-resonance absorbing properties of the sealing ring 14 also prevent resonance transmission from the plate 5, which is rigidly connected to the engine, to the cover part 10 of the encapsulation.

Since the plate 5 may be approached as closely to the rotor 3 as practically possible, allowing for free rotatability of the rotor 3, the resulting air gap is very small indeed, so that short-circuit currents from the space 8 on the pressure side to the aspiration or intake side of the fan will be very largely prevented, with the result that the fan has a particularly favorable high degree of effectiveness.

Figure 2:
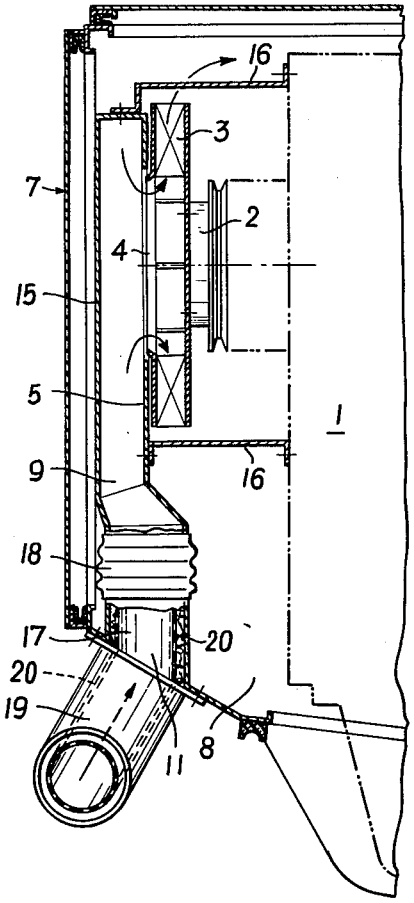
FIG. 2 is a similar sectional view of a modified embodiment of a ventilation system according to this invention.

In the embodiment of the invention shown in FIG. 2 the plate 5 which comprises the aspiration orifice 4, forms the inner wall of an airduct-housing 15 which is situated within the encapsulation 7 and rigidly secured by means of the struts 16 to the engine 1. The airduct housing 15 is connected by means of a high-elasticity rubber boot 18 with an air intake or suction pipe 17 which in its turn is rigidly connected to the encapsulation 7. In the illustrated example, the intake pipe 17 is preceded in the outward direction by an elbow pipe 19 situated externally of the encapsulation 7 to admit cooling air into the interior of this encapsulation. Both, the intake pipe 17 as well as the elbow piece 19 are lined with a sound-absorbing material 20.

The ventilation system shown in FIG. 2 also permits unimpeded relative movement between the engine 1 and the encapsulation 7, transmission of body resonance from the air duct housing 15 to the intake pipe 17 being prevented by the elastic boot 18. Furthermore, this arrangement according to FIG. 2 likewise permits the airgap between the plate 5 and the fan rotor 3 to be kept very narrow so that the efficacy of the fan is substantially improved as compared with conventional arrangements.

We claim:

1. An internal combustion engine which is encapsulated to suppress noise emission therefrom and which is ventilated in the space between the engine and the encapsulation which includes an internal combustion engine, means forming a noise-suppressing encapsulation around and in spaced-apart relationship to said engine, said encapsulation means including an intake orifice, means for ventilating the space between the engine and the encapsulation, said means including a rotatable shaft connected to said engine so as to be rotated thereby, a radial fan rotor mounted on said shaft and positioned within said encapsulation means forming an air duct for delivering air from said intake orifice of said encapsulation to the side of said radial fan rotor opposite the side facing said engine, a plate means having an aspiration orifice therein rigidly connected to said engine to be positioned very close to the side of said radial fan rotor opposite the side facing said engine, and a highly elastic, body-resonance absorbing intermediate piece positioned between said air intake orifice of said encapsulation means and said aspiration orifice of said plate means.

2. The encapsulated internal combustion engine of claim 1 wherein said means forming an air duct comprises a suction pipe connected to said encapsulation means, wherein an air duct housing is rigidly connected to said plate means to extend towards said suction pipe, and wherein said highly elastic, body-resonance absorbing intermediate piece comprises an elastic rubber boot connecting said suction pipe with said air duct housing.

* * * * *